United States Patent [19]

Yaguchi et al.

[11] 4,104,904

[45] Aug. 8, 1978

[54] HIGH-ENERGY RATE FORGING MACHINE

[75] Inventors: Hiroyasu Yaguchi, Muroran; Eishiro Ono, Noboribetsu, both of Japan

[73] Assignee: The Japan Steel Works, Ltd., Tokyo, Japan

[21] Appl. No.: 717,434

[22] Filed: Aug. 24, 1976

[30] Foreign Application Priority Data

Feb. 19, 1976 [JP] Japan ..... 51-16533

[51] Int. Cl.[2] ..... B21J 7/24

[52] U.S. Cl. ..... 72/445; 72/453.18; 91/399; 91/416

[58] Field of Search ..... 72/453.1, 453.11, 453.01, 72/445, 453.18; 91/399, 416

[56] References Cited

U.S. PATENT DOCUMENTS 2,807,081 9/1957 Black ..... 91/399

3,469,400 9/1969 Oikawa ..... 91/416

*Primary Examiner*—C.W. Lanham

*Assistant Examiner*—Gene P. Crosby

*Attorney, Agent, or Firm*—Sughrue, Rothwell, Mion, Zinn and Macpeak

[57] ABSTRACT

In a high-energy rate forging machine the piston, to which a ram is attached, is driven towards a workpiece by a high pressure gas supplied to the space above the piston within a cylinder. The space above the cylinder and the space below the cylinder are joined by holes in the cylinder and grooves in the cylinder walls. The grooves are only effective when the piston is at about the middle to lower part of its stroke. They are blocked when the piston is at or near the top part of its stroke. High speed stamping is provided without double or triple stamping and with a smooth return stroke of the piston.

2 Claims, 6 Drawing Figures

HIGH-ENERGY RATE FORGING MACHINE

BACKGROUND OF THE INVENTION

The present invention relates to a high-energy rate forging machine, which enables high-speed, precise and continuous forging.

High-energy rate forging machines, in general, are operated by supplying a high pressure gas to the piston, which moves the piston rod and the ram against the metal being forged. The gas is usually provided in a closed cycle arrangement, so that loss of discharge fluid may be minimized. Because of the gas pressure, the speed of the dropping body, including the piston, rod, and ram, is extremely high, and thus the forging operation is accelerated. The accelerated forging minimizes the period of time during which a workpiece and a ram or metal die are kept in contact with each other. This enables precise forging, coupled with controllability of operation. In addition, as a result of a minimized period of time for the ascending motion of a dropping body as well as for charging a high pressure gas into a pressure chamber, continuous forging may be effected. Unfortunately, however, there are problems associated with the prior art forging mechanism. An understanding of these problems will become apparent from a review of the following description of the prior art.

A high-energy rate forging machine of the prior art is shown in FIGS. 1 through 4 and comprises, a cylinder 1, a piston 2 having a top surface 3 and a bottom surface 4, a high pressure chamber 5, a low pressure chamber 6, an upper piston rod 7, a lower piston rod 8, a ram 9, a high pressure operating valve 10, small holes 11 provided in the piston 2, a ring-shaped seat 12, a ring-shaped valve portion 13, and a starting device 14 with a plunger 15. Operation of the machine will be referred to in conjunction with FIGS. 2 through 4.

In FIG. 2 the forging machine is shown with the lower pressure gas chamber 6 filled with a gas at low pressure. Under this condition, the dropping body, consisting of the piston 2, upper piston rod 7, lower piston rod 8 and ram 9, is moved upwards to the top position of an ascending stroke and remains in this position. At this stage the high pressure operating valve 10 is closed. The pressure acting on the upper surface 3 of the piston 2 and the pressure acting on the lower surface 4 thereof are maintained in equilibrium at a low pressure level due to the fact that the chambers 5 and 6 mutually communicate through the small holes 11 in the piston 2. The piston moves to the top of the ascending stroke position under the stated conditions because the pressure in the lower chamber is acting on a larger surface area (bottom 4) than the surface area (top 3) acted on by the pressure in chamber 5. Thus, a power resulting by multiplying the above pressure by a difference in the effective areas of the upper and lower surfaces 3 and 4 of the piston 2 causes a resultant force in the upward direction. The resultant force is predetermined so as to be greater than that required for supporting the total weight of the dropping body so that the ring-shaped valve portion 13 is urged against the ring-shaped seat 12, thereby providing a tight fit between the two members. The position of the dropping member at the top of the ascendency stroke is immediately detected by the starting device 14, which responds thereto by first opening the high pressure valve 10 and second, extending plunger 15. When valve 10 is opened a high pressure gas enters into the high pressure chamber 5 and tends to act on the piston 2 to urge it downwards. However, because most of the top surface 3 is blocked from the high pressure gas this force is predetermined to be not so great as to overcome the aforementioned upwardly acting force, so that the piston 2 remains in its top position.

Subsequently, the starting device 14 sends a signal to close the high pressure operating valve 10, and at the same time, the plunger 15 is extended to urge the dropping body downwards to some extent, overcoming the aforesaid upwardly acting force. This condition is shown in FIG. 3. At this stage, the pressure of the high pressure gas acts on the entire upper surface 3 of the piston 2, whereby the dropping body moves downwards at a high speed due to a strong downwardly acting force.

During the downward stroke of the dropping body, the high pressure gas in the chamber 5 gradually expands, presenting a lowered pressure level, while at the same time part of the high pressure gas streams downwards through the small holes 11 provided in the piston 2 to the chamber 6. At the bottom position of the downward stroke the ram 9 strikes a workpiece, thus stopping the downward motion instantaneously. The level of the impact on the workpiece is proportional to the level of pressure of the high pressure gas as well as the quantity thereof, rather than to the weight of the dropping body itself. The level of pressure and the quantity of the high pressure gas are maintained at a preset value or may be controlled with ease to a constant value, so that the forging energy may be maintained at a given value without failure.

FIG. 4 shows the dropping body in the condition where it has come to its bottom position and momentarily stopped thereat. At this instant, the pressure of the gas acting on the upper surface 3 of the piston 2 and the pressure acting on the lower surface 4 thereof are not necessarily in equilibrium because the holes 11 are quite small and it may take some time before the pressures reach equilibrium. The pressure difference between the upper and lower spaces eventually reaches an equilibrium. Consequently, an upwardly acting force commensurate with a difference in the effective areas of the upper and lower surfaces 3 and 4 results, whereby the dropping body is forced upwards to resume the initial position (the position shown in FIG. 2), thus terminating one cycle of a stroke. This cycle of the piston stroke is repeated for continuous forging.

As is apparent from the foregoing, the high-energy rate forging machine of the prior art is so constructed that the upper and lower spaces or chambers defined by the piston 2 within the cylinder communicate with each other through the small holes 11 provided in the piston, resulting in an automatic return stroke of the dropping body. However, as a practical matter these small holes 11 are not sufficiently large to pass a quantity of gas required, with the following resulting drawbacks:

1. A relatively long delay occurs between time of impact and the start of the upward stroke of the dropping body;
2. The upward motion of the piston is slow; and,
3. The pressure still remaining in the high pressure chamber 5 in the cylinder 1 after application of impact by the ram 9 onto the workpiece occasionally causes a double- or tripple-stamping.

SUMMARY OF THE INVENTION

It is accordingly an object of the present invention to provide a high-energy rate forging machine which is free from the drawbacks described. The object is achieved by providing the prior forging machine with gas passages in the cylinder walls, positioned so that they aid in the transfer of gas when the piston is at the lower portion of its stroke position.

DETAILED DESCRIPTION OF THE PREFERRED EMBODIMENTS

Figure 1:
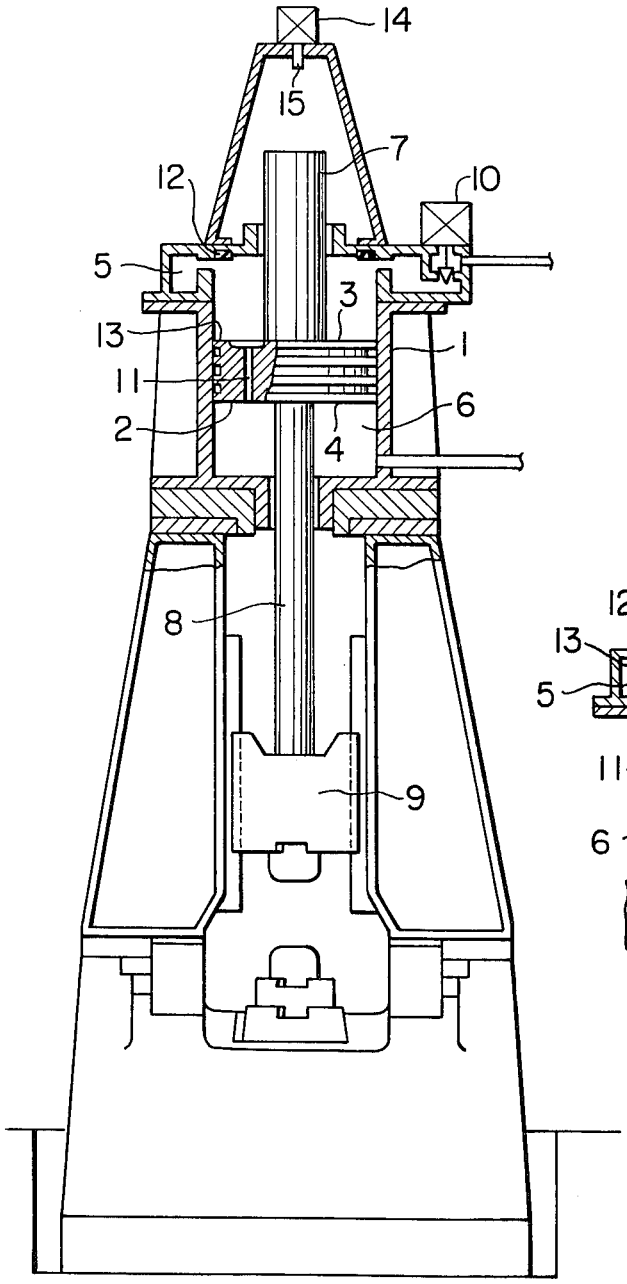
FIG. 1 PRIOR ART
FIG. 1 is a longitudinal cross sectional elevational view of a high-energy rate forging machine of the prior art.
Figure 2:
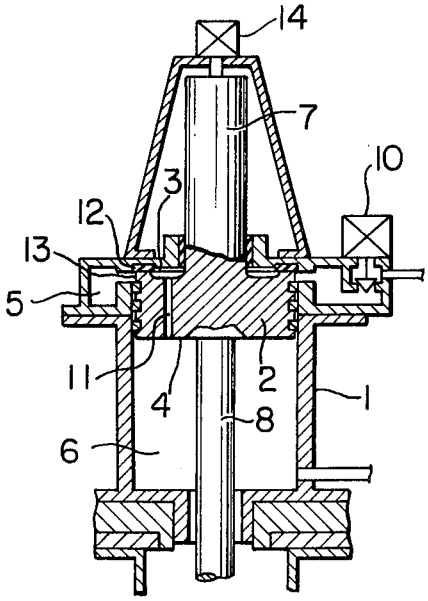
FIG. 2 PRIOR ART
FIGS. 2 through 4 are longitudinal cross sectional views showing the positional relationship between the cylinder and the piston in an operative condition of the machine of FIG. 1.
Figure 3:
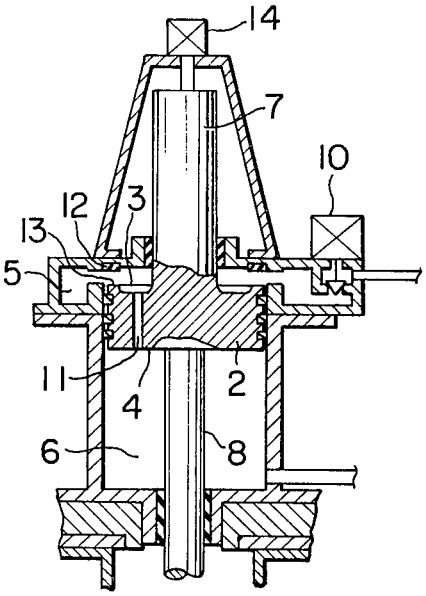
FIG. 3 PRIOR ART
Figure 4:
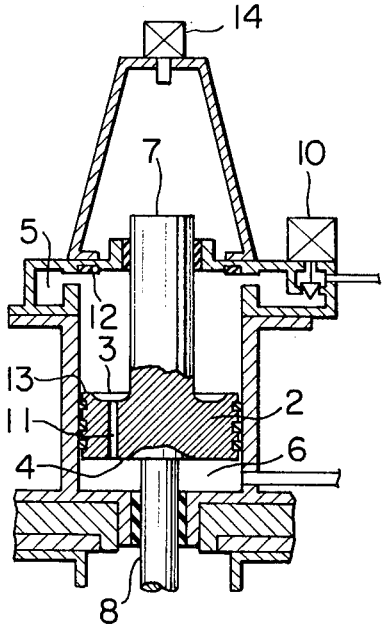
FIG. 4 PRIOR ART
Figure 5:
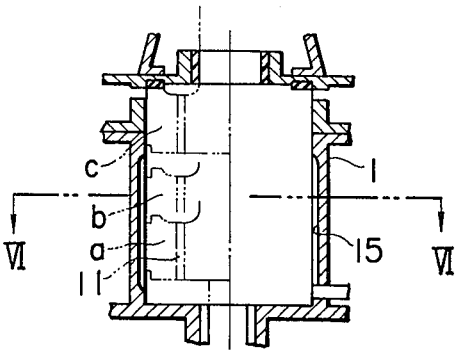
FIG. 5 is a longitudinal cross sectional view of the essential part of a high-energy rate forging machine embodying the present invention.
Figure 6:
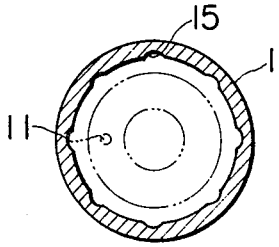
FIG. 6 is a cross sectional view taken along the line VI—VI of FIG. 5.

As is clearly seen in FIGS. 5 and 6, a plurality of lengthwise by-path grooves 15 are provided in the inner peripheral wall of the cylinder 1. Respective by-path grooves 15 are of a semi-circular shape in cross section and run from the vicinity of the top of a cylinder 1 down to the vicinity of the bottom thereof, preferably at an equal spacing from one another in the circumferential direction of the cylinder.

In operation, when the piston 2 is located in the vicinity of its bottom position *a* or intermediate position *b*, as shown by a chain line in FIG. 5, gas is circulated through the grooves 15 as well as the small holes 11 in the piston between the upper and lower spaces defined by the piston 2 within the cylinder. The quantity of gas circulating through the small holes 11 provided in the piston 2 between both spaces is extremely small, and streams of such a gas may be negligible from the operational viewpoint. When the piston 2 is located in the vicinity of the top position *c*, as shown by a chain line in FIG. 5, gas does not circulate through the grooves 15 provided in the inner peripheral wall of the cylinder 1 but only through the small holes 11 provided in the piston 2 between the upper and lower spaces of the piston 2. When the piston 2 comes in the vicinity of the top position *c* of its upward stroke and is almost stopped thereat, the grooves 15 are no longer required, but the small holes 11 provided in the piston 2 alone are required.

The by-path grooves 15 provided in the inner peripheral wall of the cylinder, according to the present invention bring about an equilibrium in gas pressure between the high pressure chamber 5 and the low pressure chamber 6 upon stamping by the ram on a workpiece, whereby double or triple stamping is avoided. The by-path grooves also ensure a smooth upward motion of the piston ram subsequent to the impact on a workpiece, as well as increasing the speed of the upward motion of the piston.

What is claimed is:

1. In a high-energy rate forging machine of the type including a piston fitted to reciprocate in a cylinder and having small holes longitudinally therethrough connecting the space above and below said piston within said cylinder, and means for connecting a high pressure gas with the said above space, the improvement comprising; a plurality of small groove means provided longitudinally in the inner peripheral wall of said cylinder at positions therein arranged to provide communication between said spaces at least when said piston is at the bottom of its stroke and arranged to not provide communication at least when said piston is at the top of its stroke, said groove means passing a negligable amount of gas during the downward stroke of said piston so that there is a negligable effect on stamping and, said groove means providing for equilibrium between the high-pressure chamber and the low-pressure chamber after stamping to prevent double or triple stamping, and providing a smooth upward return stroke.

2. The apparatus as defined in claim 1, wherein the lengths of said grooves are such that when said piston is located in the vicinity of its bottom position or an intermediate position within said cylinder, said grooves permit, in cooperation with said small holes, communication between said spaces, and when said piston is located in the vicinity of its top position, communication between said upper and lower spaces may be achieved only through said small holes.

* * * * *